US008145087B2

(12) United States Patent
Boldon et al.

(10) Patent No.: US 8,145,087 B2
(45) Date of Patent: Mar. 27, 2012

(54) EFFECTIVE SCHEDULING ALGORITHM FOR BELT SPACE CONSERVATION

(75) Inventors: Ayata J. Boldon, Rochester, NY (US); Bejan M. Shemirani, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 379 days.

(21) Appl. No.: 12/430,454

(22) Filed: Apr. 27, 2009

(65) Prior Publication Data

US 2010/0272461 A1 Oct. 28, 2010

(51) Int. Cl.
*G03G 15/00* (2006.01)

(52) U.S. Cl. ..... 399/72

(58) Field of Classification Search ..... 399/49, 399/59, 72, 76, 77
See application file for complete search history.

(56) References Cited

U.S. PATENT DOCUMENTS

| | | | | |
|---|---|---|---|---|
| 6,181,888 | B1 * | 1/2001 | Scheuer et al. | 399/49 |
| 7,224,919 | B1 * | 5/2007 | Shemirani et al. | 399/72 |
| 7,418,216 | B2 | 8/2008 | Elliot | |
| 2008/0063420 | A1 * | 3/2008 | Elliot et al. | 399/72 |

* cited by examiner

*Primary Examiner* — David Gray
*Assistant Examiner* — Billy J Lactaoen
(74) *Attorney, Agent, or Firm* — Ronald E. Prass, Jr.; Prass LLP

(57) ABSTRACT

This is a method for placing test patches along the surface of a photoconductive belt. A novel feature of this invention is locating optimum times and locations for placing the test patches by rotating the belt backwards after the first normal forward rotation of the belt.

10 Claims, 2 Drawing Sheets

EFFECTIVE SCHEDULING ALGORITHM FOR BELT SPACE CONSERVATION

This invention relates to an Electrophotographic marking system and, more specifically, to methods of using test patches in said systems.

BACKGROUND

There are several issued patents dealing with the use of test patches in xerographic marking systems. Two of these are Xerox U.S. Pat. Nos. 7,418,216B2 and 7,224,919B1. The disclosures of these patents are incorporated by reference into the present disclosure.

It is common practice in some xerographic marking systems to use test patches to monitor certain parameters of the process such as developer density, print quality, etc. The test patches are usually positioned between predetermined customer image areas called "gaps". It is generally the case that test patches which can be developed latent images are never transferred to a receiving medium like paper but rather, after developed, the developed image is tested for image density or any other quality desired. Once the desired tests are conducted on the test patches, the patches are rotated on the photoconductive belt to a cleaning station where the toner or developer is removed leaving this space or gap available for future test patches. Many times it requires several belt revolutions through the cleaning station to effectively remove all of the developer.

The test patches before removal are sensed by various sensors and monitors to measure for the properties desired in the marking system. Once these desired properties are measured, the marking system can be tweaked for any adjustments that need to be made, for example, to the toner and developer to reach the desired final toner density. The image on the test patches, as above indicated, are rarely transferred to a receiving medium because the desired measurements can be readily made directly only from the patch developed image.

Generally, a "patch" can be defined as a rectangular or other shaped area on the belt that is used for monitoring process control. These patches are usually printed between the customer image areas, also referred to as "image panels". Patches are used to control image quality. In some cases, a patch is an area of charge that is not developed. That area is read by the Electrostatic Voltmeter (ESV). Patches used to determine and control toner concentration are read by optical sensors and monitors before adjustments are made. The patches are placed in positions similar to the positions or "gaps" above defined. The control patches are sensed with any suitable sensors, such as ESV and ETAC sensors and, based on the reads, adjustments are made to the toner density, belt charge and other xerographic components to achieve the customer's desired print quality output.

Usually a test patch test is conducted when software customers make requests to use space on the belt to position these images (patch). Availability of space on the belt is based on questions such as: do we have time to print this image and is there space on the belt that has not already been used? The customer's request will then be scheduled once determinations have been made results forwarded to the customer.

Under the prior art approaches prior to the implementation of the algorithm presently defined in this invention, when a patch request is received, the time of the start of the seam zone of the next forward or normal belt revolution is checked against the time necessary for patch transfer to determine if the patch request could be allocated at that time. This causes a problem because there are many cases where unsearched panels in a previous normal belt revolution could have been used to schedule the patch request. However, because of the scheduling algorithm in use, patches are being scheduled on average usually 1100 milliseconds later than actually possible based on availability of space at the time of request.

SUMMARY

The present invention discloses a method and scheduling algorithm in which instead of searching from the beginning of a normal or forward photoconductor (PR) belt revolution to determine if a process controls patch can be scheduled at or after time x, searching in the present invention is performed from the end of a belt revolution back to check to see if a patch can be scheduled at or before time x. Once it is determined that a patch can be scheduled at time x, the algorithm iterates backwards rather than the normal forward revolutions through current times available within that belt revolution until it finds the smallest time x whereby the patch can be scheduled. In this way, belt space is conserved and images are scheduled earlier. The existing prior approach searches from the beginning of the next forward belt revolution which generally wastes time when scheduling requests that sometimes come in during a normal forward belt revolution. The balance of the current belt revolution is not considered in the prior art existing approaches but is necessarily used in the approach proposed in this invention. A benefit of 1100-1800 milliseconds is obtained using the method of the present invention or approach. This results in more timely image quality measurements and shorter first print out time than possible in the prior art methods.

Thus, this invention provides a method of a scheduling algorithm whereby it is unnecessary to search from the beginning of a normal belt revolution to determine if a patch can be scheduled at time x and beyond. Instead, searching can begin at the end of a belt revolution and checked to see if a patch can be scheduled at or before time x. As noted earlier, once it is determined that a patch can be scheduled at time x, it can be iterated backwards through current times available within that belt revolution until the smallest time x is found whereby the patch can be scheduled. In this way, belt space is conserved and test patches are scheduled earlier.

DETAILED DISCUSSION OF DRAWINGS AND PREFERRED EMBODIMENTS

Figure 1:
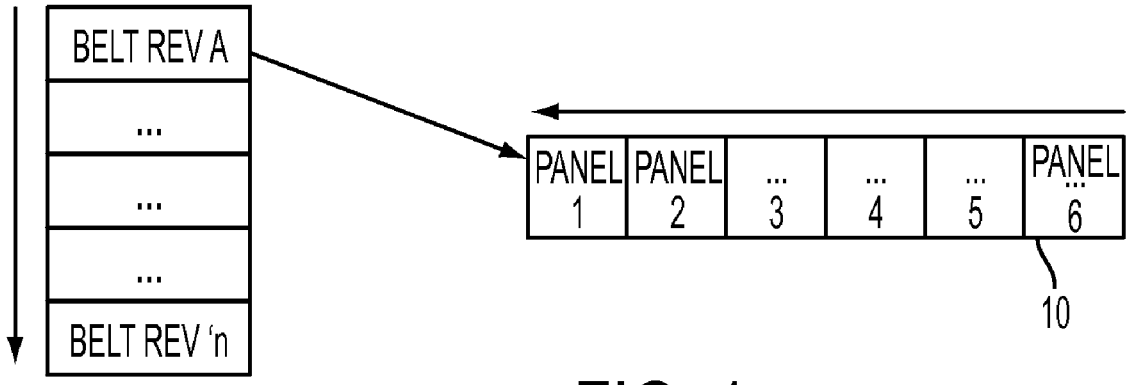
FIG. 1 illustrates an embodiment of this invention showing revolutions and panel configurations.

An embodiment of the invention is described below and illustrated in FIG. 1-4. When a request is received to schedule patch, the list of gaps or space 7 available on the belt 10 is broken down into blocks or panels 1-6 based on time increments necessary to print a page based on the patch selected for the current job. This layout includes an interdocument zone or gap 7 which is used for printing patches 12 which are used to monitor and adjust print image quality based on reads taken from sensors 8 located within the print engine marker module. When the request is received, it generally contains the following information: (a) zone, (b) earliest time patch can be printed and (c) latest time patch can be printed.

Based on the time and zone requested, the present method and algorithm searches through the list of available spaces or gaps 7 on the belt 10 beginning at panel 6 of Belt Revolution A in the list, as shown in FIG. 1. The algorithm searches through the list of panels 1-6 in the current belt rev A starting at the end at panel 6, iterating backwards to panel 1 until it finds a panel where the time it will take to schedule the panel is greater than or equal to the minimum time requested and less than or equal to the latest time at which this patch 9 can be scheduled according to the associated request. In this way, the earliest time available to coordinate patch scheduling is found. In addition, it is possible to minimize unused space on the belt 10 by searching through every belt revolution A-N backwards minimizing the time it takes to search and the efficiency of conservations of space on the belt is maximized.

In order for the method of this invention to proceed, there must be in existence the concept of both belt revolutions and panels 1-6 or some form of blocks used for the allocation of space by which patches 9 and images can be scheduled for printing. In addition, for this algorithm to be used there must be the existence of a time constraint which will be used to evaluate if a panel is within bounds to be allocated for usage. In the description as shown in FIG. 1, best use of this algorithm requires the use of: (a) the zone or panel, (b) the earliest time the patch can be printed and (c) the latest time the patch can be printed to achieve optimal results with regard to belt conservation. Nonetheless, the algorithm can be used with only the concept of a minimum time required for patch 9 transfer which is known by the system using the algorithm.

The test patch 9 is a rectangular or other shaped area on the belt 10 which is used for monitoring process control. These patches 9 are usually printed between the customer image areas or panels 1-6, also referred to as Image Panels 1-6. Patches 9 are primarily used to control image quality. In some cases a patch is an area of charge that is not developed such as a latent image.

Figure 2:
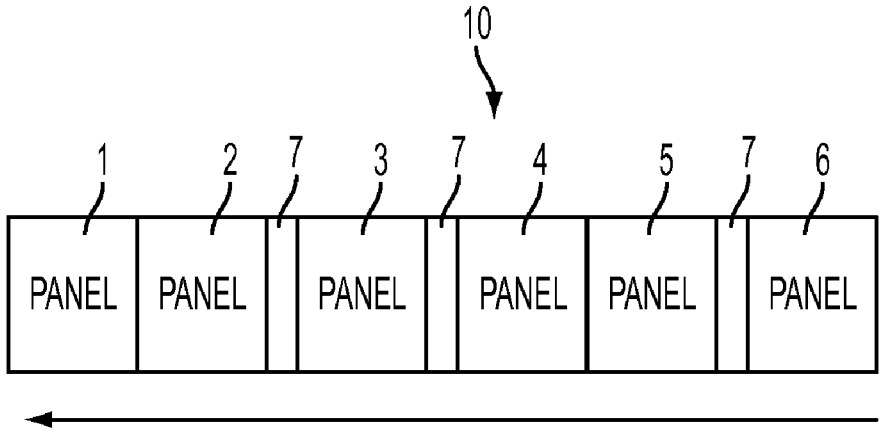
FIG. 2 illustrates a top view of a photoconductive (PR) belt surface useful in the method of this invention.
Figure 3:
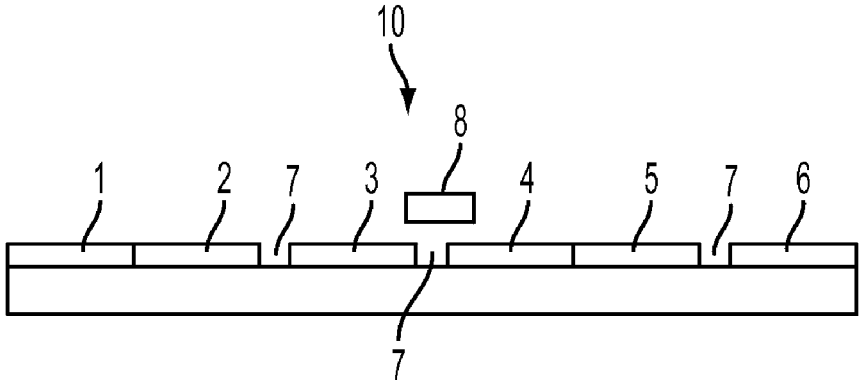
FIG. 3 illustrates a side view of the belt of FIG. 2.
Figure 4:
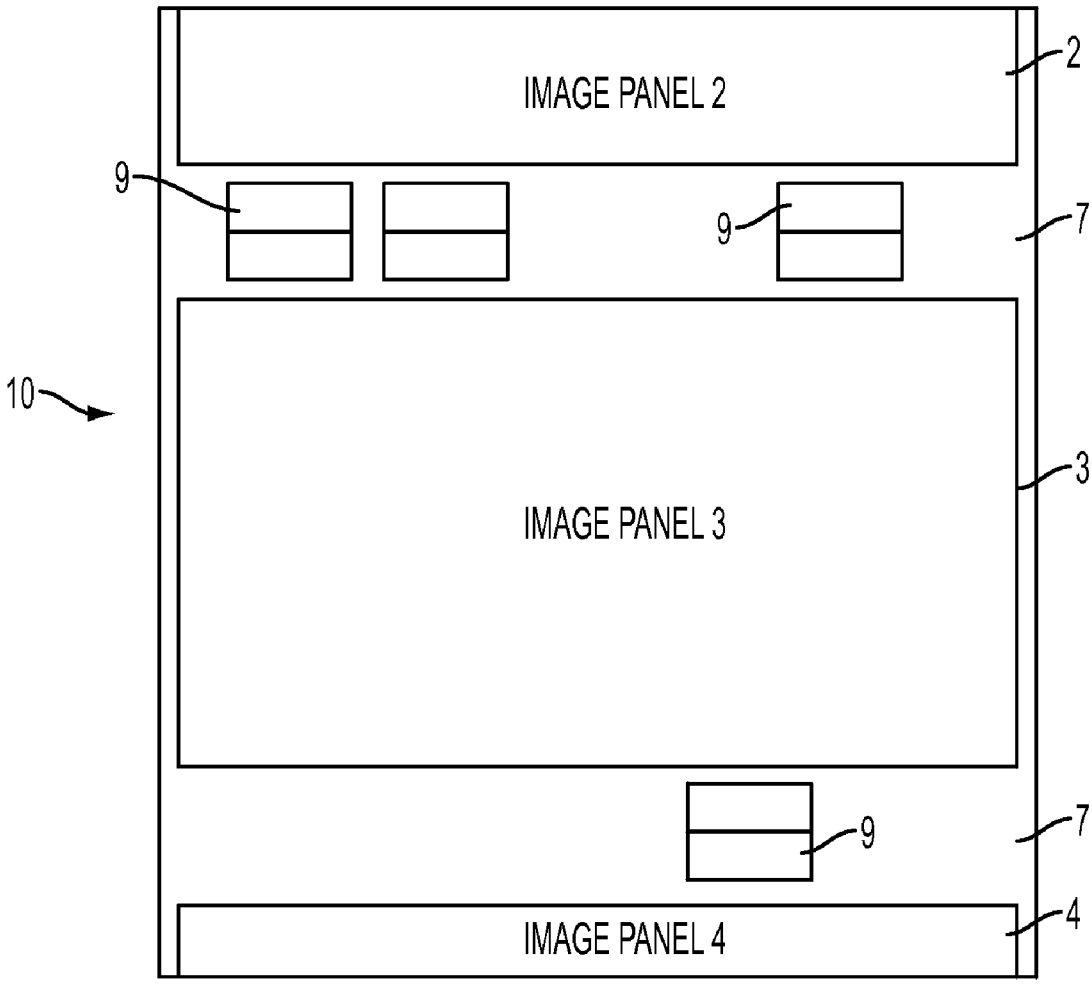
FIG. 4 illustrates a patch located in gaps that are in between panels of the PR belt.

In FIG. 4, a top view of photoconductive belt 10 is shown with a space or gaps 7 located between panels 2 and 3 (of FIG. 2) and panels 3 and 4 also of FIG. 2. The belt as shown in FIGS. 2 and 3 is broken down into blocks or panels 1-6, all of about the same size. The test patches 9 (any number of them) can be located in gaps 7 as shown or in any other panel-gap configuration. As earlier noted, the patches positioned in the gap 7 can be only an undeveloped latent image or can be a developed image depending on the information desired. For example, if toner density is requested, obviously a developed or toned test patch 9 will be used so that toner is available for the tests. A sensor or sensors 8 will sense or identify the areas 1-6 of image and the gaps or spaces 7.

The algorithm developed in the present invention changes the current prior art software implementation so that space on the belt is used more efficiently to schedule patches 9 requested by customers to be transferred at the next available location as opposed to the previous implementation which waited until the next belt revolution to check where and if the requested patch could be scheduled. As earlier stated, a major benefit is that the patches requested are scheduled about 1100-1800 milliseconds earlier than under the prior art systems. This will allow the first print to leave the marking machine and arrive in the customer's hands faster. That area is read by sensors, such as the Electrostatic Voltmeter (ESV) 8. Patches used to control toner concentration are developed and read by optical sensors 8. The patches 9 referred to are placed in positions similar to the positions or "gaps" 7. The control patches 9 are sensed with ESV and ETAC sensors 8 and based on the reads adjustments are made to the toner density, belt charge and other xerographic components to achieve the customer's desired print quality output.

Therefore, the present method provides for a searching algorithm which searches across belt revolutions beginning at the most current belt revolution which can be scheduled and concurrently within that belt revolution Panel n (the last panel) to find the earliest space that can be utilized to schedule the patch/image. As earlier noted prior to this invention, no method was implemented to find the earliest panel whereby a patch/image could be scheduled.

The benefits of the method of this invention include the following:

(a) patches are scheduled between 1100-1800 milliseconds, (b) image quality measurements will be taken earlier due to patches being scheduled earlier, (c) the first print leaves the printer more quickly because image quality measurements are assessed earlier, and (d) better than other alternatives because this algorithm can be ported across scheduling processes to achieve better efficiency.

In a first embodiment, this is a method for determining a requested time and location where a test patch can be positioned on a belt having a photoconductive (PR) surface. This method comprises providing a photoconductive belt surface, sectioning off this surface into panels of approximate equal dimensions, and also providing at least one sensor adjacent the PR surface. This sensor is configured to identify on the belt imaging areas and gaps between these imaging areas and putting the belt through at least one complete revolution, then iterating the belt backwards until it is determined via sensor (s) and monitors where the time and location it will take to schedule a test patch location at the requested time and location. The test patch is an undeveloped latent image or is a developed or toned image. One of the determinations to be made is an earliest time available to coordinate this patch scheduling. In all embodiments of this invention, the belt is iterated or rotated backwards through current times available within a belt revolution until a smallest time is determined where a patch can be located or scheduled.

In summary, the present invention provides embodiments of a method of determining an optimum location for a test patch on an electrophotographic (PR) belt surface. An embodiment of this method generally comprises providing a request with parameters desired for a xerographic marking system and to schedule a test patch placement to find the earliest locations or spaces than can be utilized to schedule this placement. Subsequently, imaging areas are determined on the PR belt surface and the location of gaps or spaces between these imaging areas is determined. This information is obtained by first providing monitors or sensors along the belt surface, the monitors configured to adjust image quality based upon these sensors, then providing panels along a length of the PR surface. Each panel comprises imaging areas and available gaps between these areas on said surface and finally searches through a list of these panels starting with a last panel and iterating backwards until a panel is found where a time to schedule a test patch in that panel is greater than or equal to the minimum time requested or equal to the test time at which a patch can be scheduled according to said request. In this embodiment, a searching algorithm is determined which searches across belt revolutions beginning at a most current belt revolution and subsequently starting with a last panel, rotating the belt surface beginning with a last panel to determine an earliest space of gap that can be utilized to schedule and locate the test patch. A time is provided in the request for scheduling positioning of a test patch. The belt surface is iterated backwards through current times available with a belt revolution until a smallest time is determined via sensors when said test patch can be scheduled. The request usually comprises a panel to place said test patch, an earliest time the patch can be located and printed, and a latest time the patch can be loaded and printed. The test patches schedules are sensed by a sensor and based upon a monitor and sensor readings. The test patches components are adjusted until the customers requested desired print quality is achieved.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of determining an optimum location for a test patch on an electrophotographic belt surface, a sensor being located along said belt surface, the method comprising:

providing a request from a customer or others to schedule a test patch placement and to find the earliest spaces than can be utilized to schedule said placement, determining imaging areas on said belt surface and determining location of gaps or said spaces between said imaging areas, providing panels on and along a length of said surface, each panel comprising any available gaps on said surface, and searching through a list of panels starting with a last panel and iterating the surface backwards until a panel is found where a time to schedule a test patch in that panel is greater than or equal to the minimum time requested or equal to the latest time at which a patch can be scheduled according to said request.

2. The method of claim 1 wherein a searching algorithm is determined which searches across belt revolutions beginning at a most current belt revolution and subsequently starting with a last said panel, rotating said belt surface beginning with a last panel to determine an earliest space of gap that can be utilized to schedule and locate said test patch.

3. The method of claim 1 whereby a time is provided for scheduling positioning of a test patch, said belt surface is iterated backwards through current times available with a belt revolution until a smallest time is determined when said test patch can be scheduled.

4. The method of claim 1 wherein said request comprises a panel to place said test patch, an earliest time said patch can be located and printed and a latest time said patch can be located and printed.

5. The method of claim 1 wherein said test patches are sensed by said sensor and based upon sensor readings, said test patches components are adjusted until said customers desired print quality is achieved.

6. A method for determining a requested time and location where a test patch can be positioned on a belt having a photoconductive (PR) surface, said method comprising:

providing said photoconductive belt surface, sectioning off said surface into panels of approximate equal dimensions, providing at least one sensor adjacent said PR surface, said sensor configured to identify on said belt imaging areas and gaps between said imaging areas, and putting said belt through at least one complete revolution, and subsequently iterating said belt backwards until it is determined via said sensor(s) where the time and location it will take to schedule said test patch location at said requested time and location.

7. The method of claim 6 wherein said test patch is an undeveloped latent image.

8. The method of claim 6 wherein said test patch is a developed or toned image.

9. The method of claim 6 in which an earliest time available to coordinate patch scheduling is determined.

10. The method of claim 6 wherein said belt is iterated backwards through current times available within a belt revolution until a smallest time is determined where a patch can be located or scheduled.

* * * * *